US006444956B1

(12) United States Patent
Witcher et al.

(10) Patent No.: US 6,444,956 B1
(45) Date of Patent: Sep. 3, 2002

(54) HAND LOTION WARMER

(76) Inventors: Elizabeth Witcher, 4225 Tall Hickory Trail, Gainesville, GA (US) 30506; Michael Witcher, 4225 Tall Hickory Trail, Gainesville, GA (US) 30506

( * ) Notice: Subject to any disclaimer, the term of this patent is extended or adjusted under 35 U.S.C. 154(b) by 0 days.

(21) Appl. No.: 09/911,192

(22) Filed: Jul. 23, 2001

(51) Int. Cl.[7] ..... A47K 5/00; F27D 11/00; B67D 5/63

(52) U.S. Cl. ..... 219/429; 219/432; 219/433; 219/386; 219/435; 222/146.5

(58) Field of Search ..... 219/429, 432, 219/433, 441, 442, 385, 386, 435

(56) References Cited

U.S. PATENT DOCUMENTS

| | | | | | |
|---|---|---|---|---|---|
| 1,805,291 | A | | 5/1931 | Monnot | |
| 2,413,176 | A | * | 12/1946 | Deaton | 219/433 |
| 2,604,573 | A | | 7/1952 | Raines et al. | 219/45 |
| 3,005,904 | A | * | 10/1961 | Thompson | 219/433 |
| 3,152,245 | A | * | 10/1964 | Litman | 219/433 |
| 3,769,495 | A | * | 10/1973 | Orfei | 219/433 |
| 3,896,973 | A | * | 7/1975 | Morgan | 219/433 |
| 4,370,130 | A | * | 1/1983 | Berger | 219/421 |
| 4,694,973 | A | * | 9/1987 | Rose et al. | 219/433 |
| 4,700,048 | A | | 10/1987 | Levy | 219/214 |
| D301,923 | S | * | 6/1989 | Koschuta | D23/332 |
| 5,057,671 | A | | 10/1991 | Colson | 219/521 |
| 5,216,948 | A | * | 6/1993 | Sheppard et al. | 219/385 |
| 5,248,870 | A | | 9/1993 | Redal | 219/521 |
| 5,700,991 | A | | 12/1997 | Osbern | 219/430 |
| 5,906,763 | A | | 5/1999 | Wheeler | 219/286 |
| 6,204,485 | B1 | * | 3/2001 | Williams | 219/429 |

FOREIGN PATENT DOCUMENTS

| | | | |
|---|---|---|---|
| GB | 2236386 | * | 4/1991 |

* cited by examiner

*Primary Examiner*—Joseph Pelham
(74) *Attorney, Agent, or Firm*—Brian S. Steinberger; Law Offices of Brian S. Steinberger, P.A.

(57) ABSTRACT

A device for both warming substances and for providing a nightlight. The device can have a single opening in a upper lid portion for allowing various sized containers of substances to be inserted therein. The substances can include lotions, creams, pastes, gels, liquids, and the like. Controls such as rheostats can be adjusted to select desired nightlight intensity levels and desired temperature levels. Timers can adjust when the rheostat settings are to be turned on and off. Visual and/or audible alarms can be activated when selected levels have been reached. The device can have a clock for giving off the current time.

20 Claims, 6 Drawing Sheets

Fig. 3
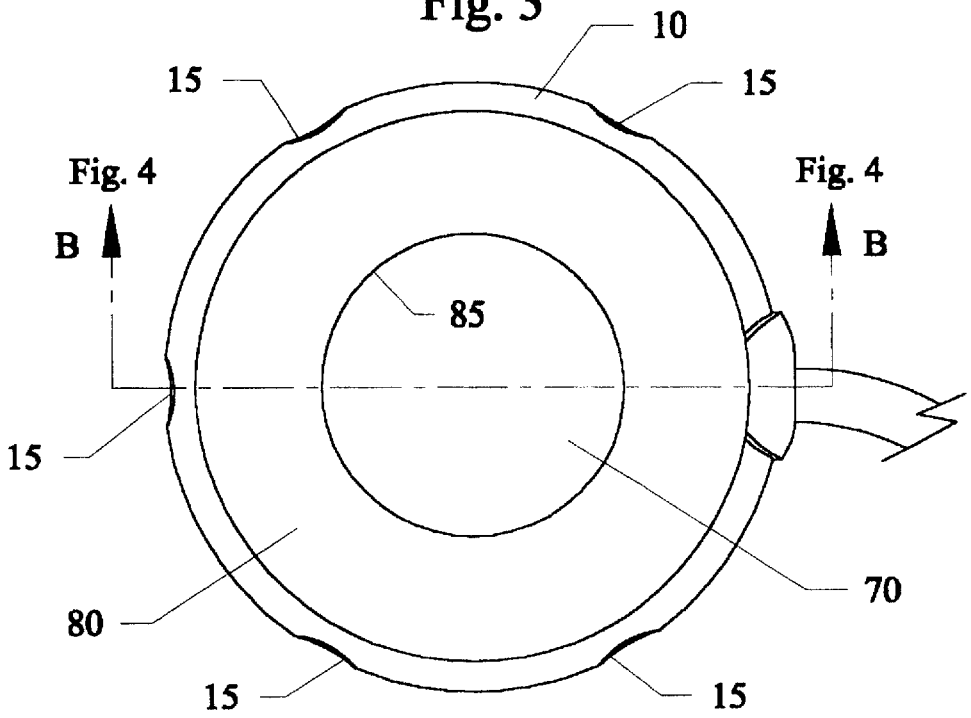
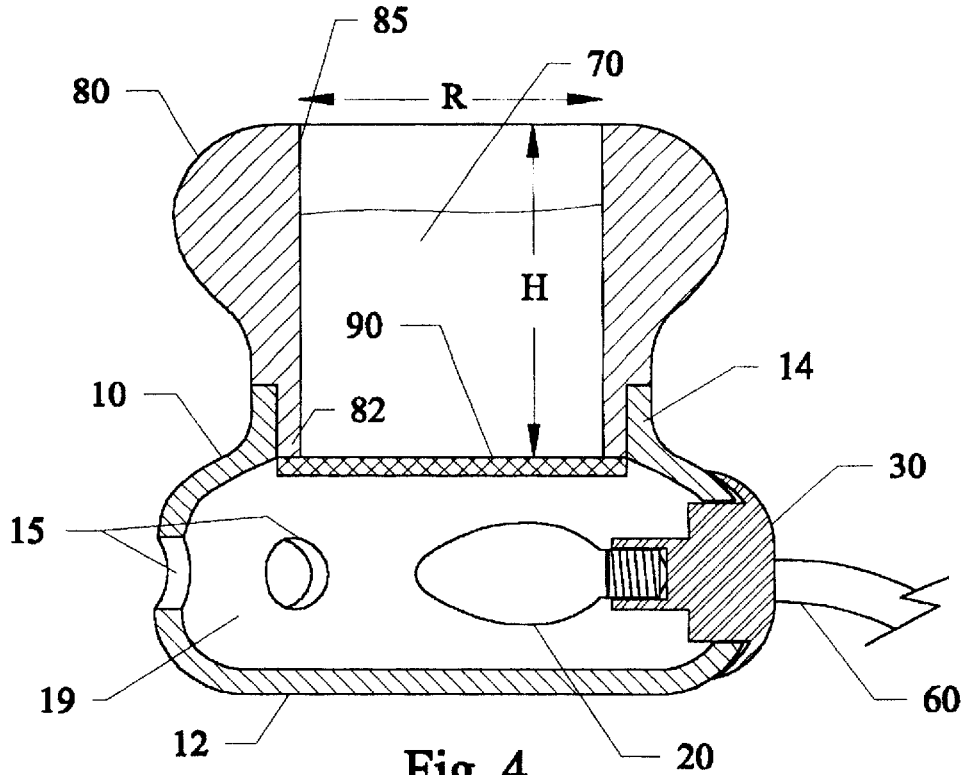
Fig. 4

100
210
230
220
150
115
50
60
40

D
D

230

220

210

HAND LOTION WARMER

This invention relates to liquid holders, and in particular to a combination nightlight and warmer controller for substances such as hand lotions, creams, liquids, and the like.

BACKGROUND AND PRIOR ART

A common problem with using hand lotion when going to bed is that the lotion is sometimes cool and uncomfortable when being applied. This problem is further compounded in cold climates when the lotion has been stored in a bathroom cabinet. Over the years several proposals have been made to warm liquids in receptacle devices. Similar problems occur with other types of substances such as creams, moisturizers, liquids, and the like.

Traditional nightlights such as plug-ins used adjacent to beds and/or in bathrooms are generally limited to only providing a light source and do not function for other purposes. Additionally, nightlights generally turn off when optical sensors indicate that daylight as occurred. Thus, traditional nightlights can have a short lifespan since they run continuously throughout the night.

U.S. Pat. No. 2,604,573 to Raines et al. describes a combination nightlight and bottle warmer. However, this unit is limited to only holding one bottle at a time, and not several lotions and creams that may be desirable to be warmed by the user. Additionally, short containers of liquids, creams or lotions would slip far into the tall housing of Raines et al., and be difficult to retrieve. Furthermore, this nightlight must be manually turned on and off.

U.S. Pat. No. 5,057,671 to Colson describes a solution-warming unit which can also be used as a nightlight. However, this unit is limited to cylindrical openings, in particular to "4(2 ⅝") holes(in the lid portion) . . . to house the necessary 4(16 oz.) bottles . . . ", and a wide open space underneath the lid portion, column 2, lines 34+. Thus, this unit is limited to being able up to only four "(16oz.)" cylindrical type bottles. Although Colson describes being able to also insert "4 oz." Bottles, a side door is required to be opened and closed in addition to having the plural openings on the top portion. If a user tries to insert and/or retrieve the smaller bottles through the lid portion, the shorter and smaller containers can easily become lost in the wide open space underneath the lid portion. Furthermore, this nightlight must also be manually turned on and turned off.

U.S. Pat. No. 5,248,870 to Redal describes a unit similar to Colson '671 but with a cylindrical insert. Similar to Colson '671, this unit is also limited to storing one size of a bottle, and is not useable different height and sizes of containers holding liquids, lotions and creams that are used. Additionally, this device also does not teach more than manually turning on or off a nightlight.

Other patents known to the inventor that also fail to overcome the deficiencies of the above cited references include U.S. Pat. No. 1,805,291 to Monnot; U.S. Pat. No. 4,700,048 to Levy; U.S. Pat. No. 5,700,991 to Osbern; and U.S. Pat. No. 5,906,763 to Warren Van Deventer Wheeler.

Additionally, all of the prior art devices do not allow the user to control either or both the light intensity of the nightlight and the heat settings. Users desiring to heat some lotions to different degree settings have not control over the heating temperatures or the length of time that heating is to take place. Furthermore, none of the prior art devices allow the user to automatically shut off the heating and/or nightlight modes. Thus, these prior art devices may constitute a safety hazard if the heating units are left one too long. Also, too long heating could burn and ruin the lotions, creams and liquids being warmed, and can ultimately destroy expensive lotions, creams, and liquids over time. Thus, the need exists for solutions to the problems of the prior art described above.

SUMMARY OF THE INVENTION

The first objective of the invention is to provide a device for both heating liquid containers and for providing a nightlight.

The second objective of the invention is to provide a device with a single opening in a lid portion for receiving and heating several size containers of liquids, lotions, and creams of various sizes and shapes simultaneously.

The third objective of the invention is to provide a device for controlling the light intensity of the nightlight that is also used to heat various containers of liquids, lotions and creams.

The fourth objective of the invention is to provide a device for selectively controlling the temperature heating settings of a light that is used to heat containers of liquids, lotions and creams, where the light is also used as a nightlight.

The fifth objective of the invention is to provide a device for both heating containers of liquids, lotions, creams, and the like, and for also providing a nightlight, where the light and/or heat source can be selectively turned on and off at selected times.

The sixth objective of the invention is to provide a device for both heating containers of substances and for providing a nightlight, which as a safety control for deactivating the device after a preselected period of time.

The seventh objective of the invention is to provide a device for both heating containers of substances and for providing a nightlight, which adjusts the heating source and nightlight to a lower setting automatically after a preselected period of time.

The eighth objective of the invention is to provide a device for both heating containers of substances and for providing a night light having an alarm such as a visual light and/or a sound that alerts the user when a selected heating time and/or temperature has been achieved.

A preferred embodiment of the invention allows for a device to have an opening in a lid portion of a receptacle for allowing various sized containers such as but not limited to tubes, flasks, bottles, jars, and cylindrical containers to be inserted therein, and be able to easily removed by the user. A grid underneath the receptacle separates the receptacle from a housing that stores a heating and lighting source therein. The heating and light source can be an incandescent bulb, and the like. Controls such as a rheostat allow for setting various intensity and temperature settings. A timer allows for activating and deactivating the intensity and temperature settings. Visual and/or audible alarms can occur after a selected time period has occurred. The novel receptacle device can be powered by a standard AC(alternating current) outlet and allows the user to place one or more containers of liquid such as hand lotion, creams, and the like, in the upper opening of the device.

Further objects and advantages of this invention will be apparent from the following detailed description of a presently preferred embodiment which is illustrated schematically in the accompanying drawings.

BRIEF DESCRIPTION OF THE FIGURES

FIG. 3 is a top view of the warmer and nightlight device of FIG. 2 along arrow A.

FIG. 4 is a cross-sectional view of the warmer and nightlight device of FIG. 3 along arrows B—B.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
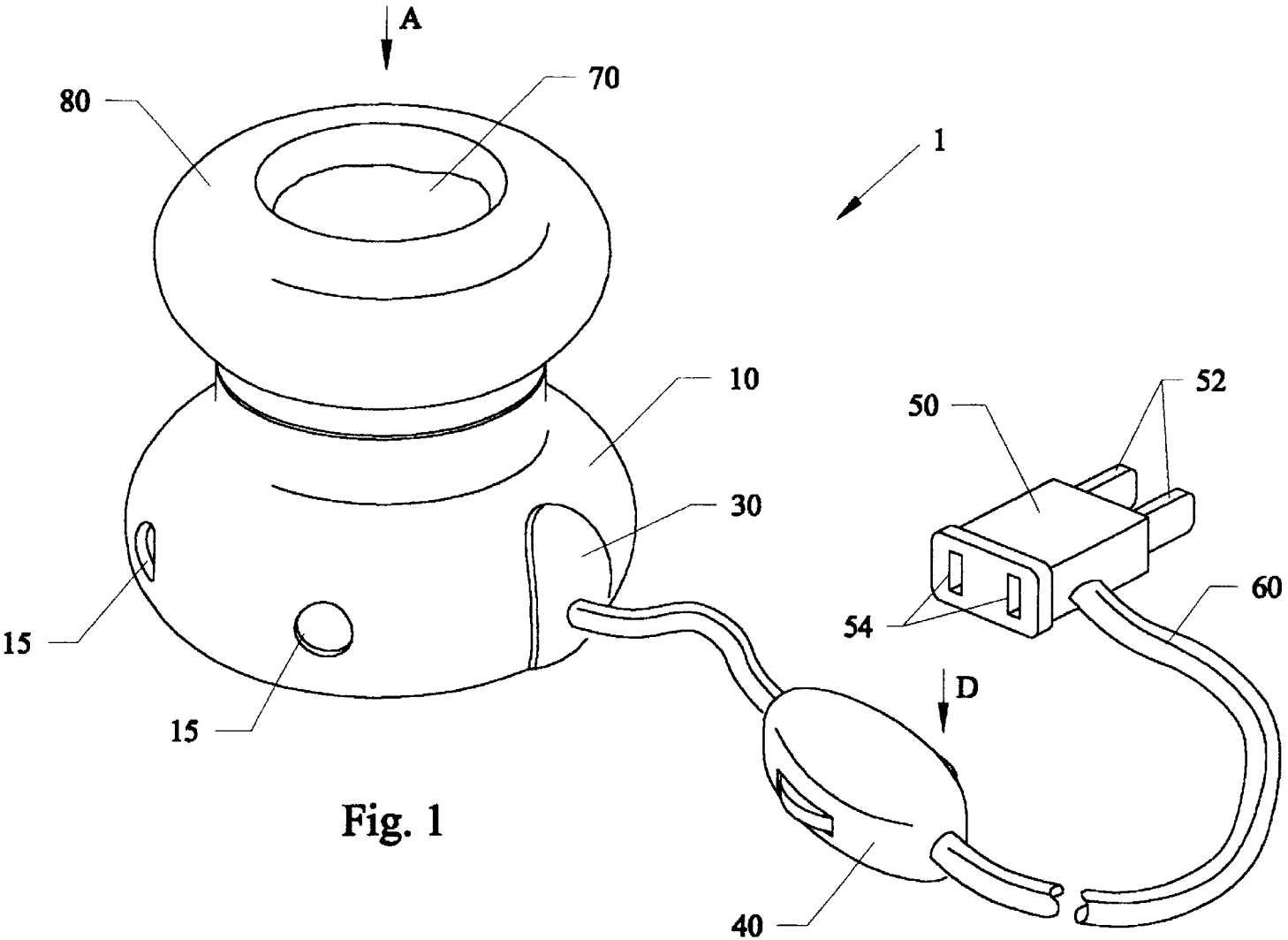
FIG. 1 is a perspective view of a preferred embodiment of the warmer and nightlight device without any containers inside the device.
Figure 2:
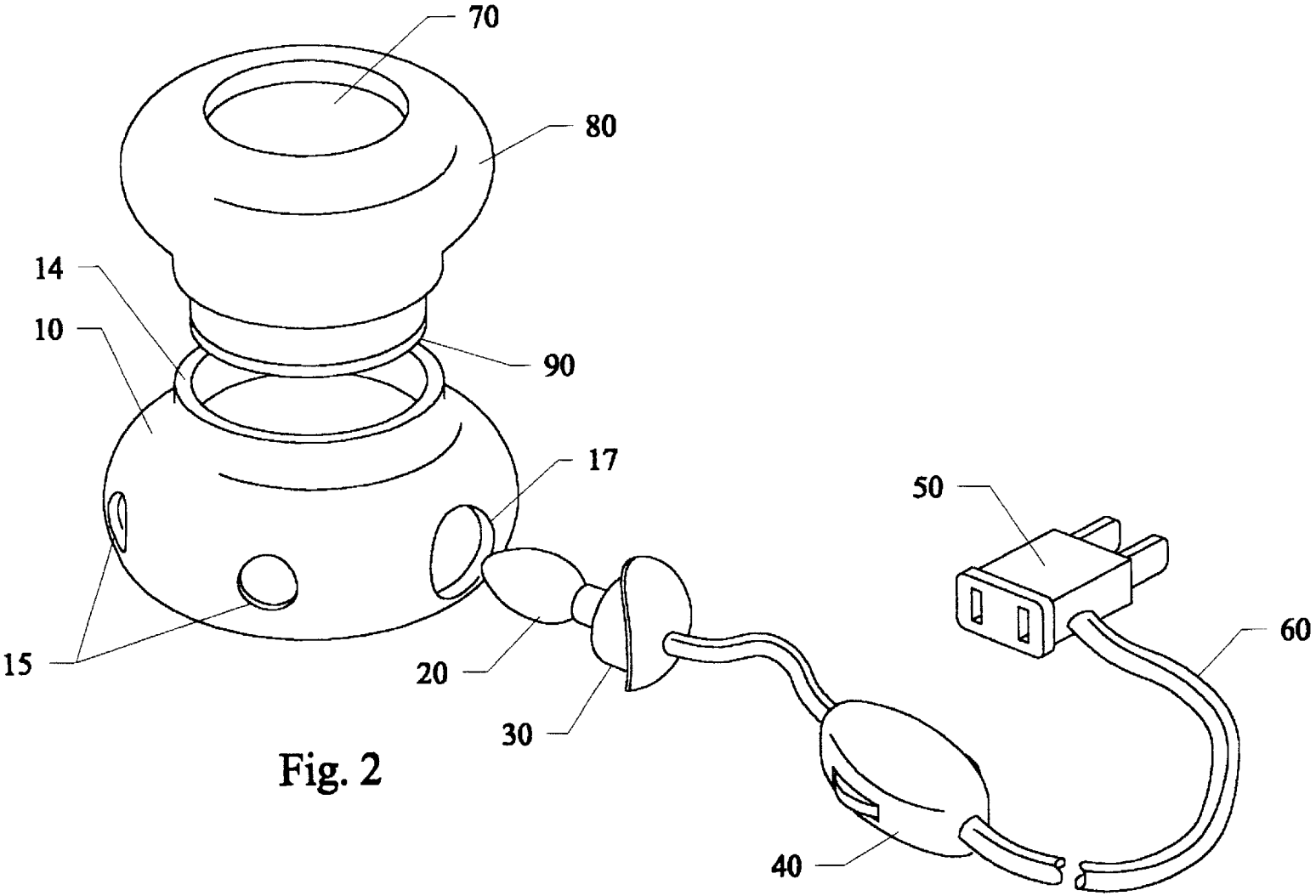
FIG. 2 is an exploded view of the warmer and nightlight device of FIG. 1.

FIG. 1 is a perspective view of a preferred embodiment 1 of the warmer and nightlight device 1 without any containers inside the device 1. FIG. 2 is an exploded view of the warmer and nightlight device 1 of FIG. 1. FIG. 3 is a top view of the warmer and nightlight device 1 of FIG. 2 along arrow A. FIG. 4 is a cross-sectional view of the warmer and nightlight device 1 of FIG. 3 along arrows B—B.

Referring to FIGS. 1–4, the device 1 includes a lower nightlight housing 10 that can have convex type rounded side edges with openings 15 therethrough that can be circular in shape. A side-cutout 17 in the housing 10 can be sized to receive a lamp receptacle plug 30 having a replaceable light source 20 such as a small incandescent bulb, and the like, that can be easily inserted into housing 10, and held in place by a tight type side-cutout 17. Additionally, the side-cutout 17 can also include threads with mateable threads on the inner portion of plug insert 30 so that plug insert can be rotatably tightened into side-cutout 17. A standard power cord 60 can attach light source 20 to a rheostat type control 40(the details of which will be explained later in reference to FIG. 8) for controlling light and heat intensity of the light source 20. The opposite end of cord 60 can include an Alternating Current(AC) plug 50 having prongs 52 for fitting into a conventional 120 volt wall power supply receptacle, and receptacles 54 on the plug 50 for allowing other electrical appliances(not shown) to be able to use the same power supply as plug 50. A lower surface 12 of housing 10 can have a flat type surface for allowing the device 1 to be supported on a tabletop such as a nightstand, a bathroom countertop, and the like, or even a floor surface. An upper portion 14 of the housing 10 can include a neck portion 14.

On top of base housing 10 can be a removable receptacle 80 having a cylindrical type opening 85 therethrough, with a warming portion 90 that can be a metal type plate, and the like. Receptacle 80 can also have convex type rounded sides with a lower narrow base 82 that can be sized to be received within the upper hollow neck 14 of housing 10. Additionally, the fitting between base portion 82 and upper neck 14 of housing 10 can include mateable threads on both sections 82 and 14 so that the receptacle 80 can be rotated onto the housing 10. Substances 70 such as lotions, creams, and liquids can be directly poured into opening 85 of receptacle 80 while receptacle 80 is attached to or not attached to housing 10. Similarly, after the substances have been heated, the receptacle 80 can be separated from housing 10. A separate window 19 can also be used in housing 10 having different colors, and the like so that the light source 20 is not visible through the side openings 15 of the housing 10.

The height, H, of opening 85 of receptacle 80 can be approximately 4 inches to approximately 8 inches high, and the diameter R, of the opening 85 of the receptacle 80 can be approximately 3 inches to approximately 6 inches wide. Housing 10 and receptacle 80 can be formed from injection molded hardened plastic, fiberglass, and the like, that is not susceptible to melting at temperatures of up to approximately 120 degrees. Side openings 15 less than the diameter of light source 20. For example, if light source 20 uses a ½ inch diameter bulb, each of the openings 15 can be approximately ¼ inch in diameter. Although, not shown an optional lid can be used on top of opening 85 if liquid is directly poured into receptacle 80. Additionally, containers holding the substances to be warmed can also be used in the opening of receptacle 80 as later described in detail to FIG. 7.

Figure 6:
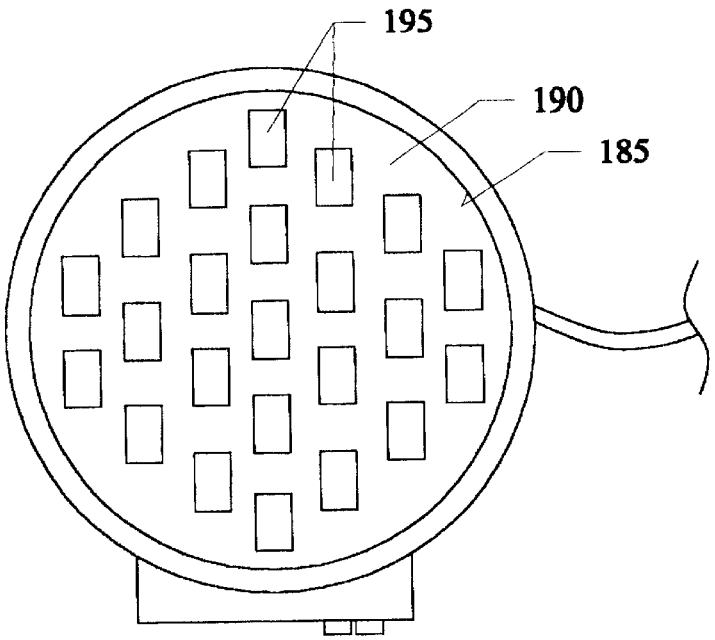
FIG. 6 is a top view of the warmer and nightlight device of FIG. 5 along arrow C.
Figure 5:
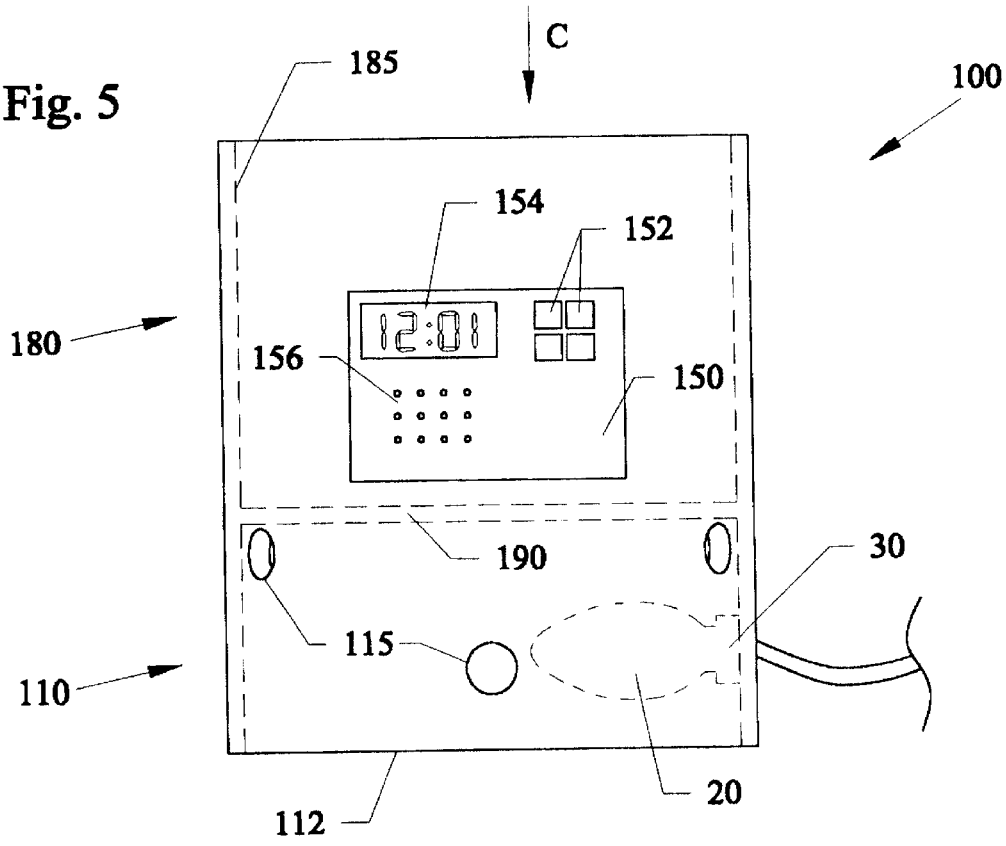
FIG. 5 is a side view of a second embodiment of the warmer and nightlight device.
Figures 7, 8, 10A, 10B, 10C:
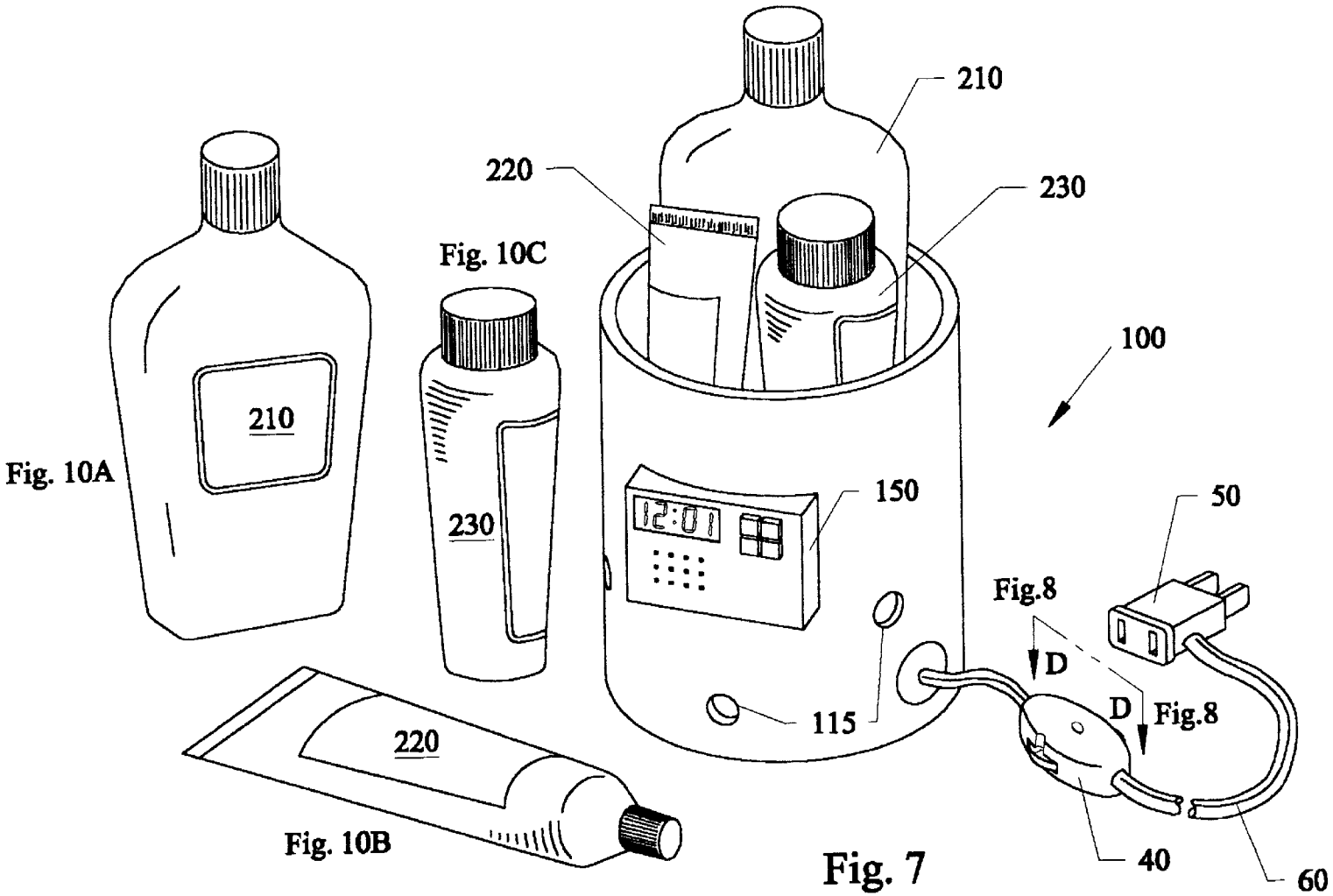
FIG. 7 is a perspective view of the second embodiment with various sized containers.
FIG. 8 is a top view of the rheostat control of FIGS. 1 and 7 along arrow D.
FIGS. 10A, 10B, and 10C show examples of different containers that can be held within the receptacles of the preceding embodiments.
Figure 9A:
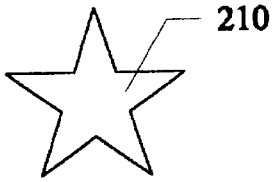
FIGS. 9A, 9B, 9C, 9D, 9E and 9F show additional side openings for the nightlight portion of the device of the preceding figures.
Figure 9B:
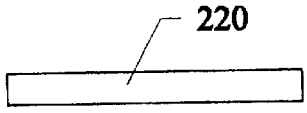
Figure 9C:
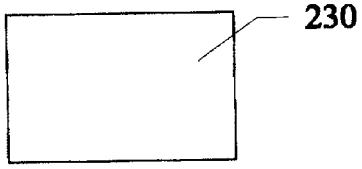
Figure 9D:
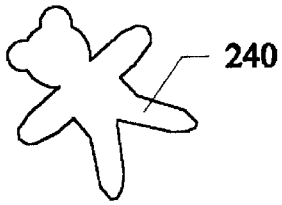
Figure 9E:
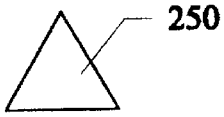
Figure 9F:
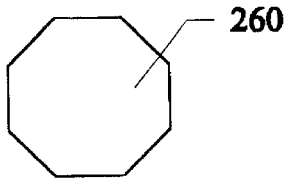
Figure 8:
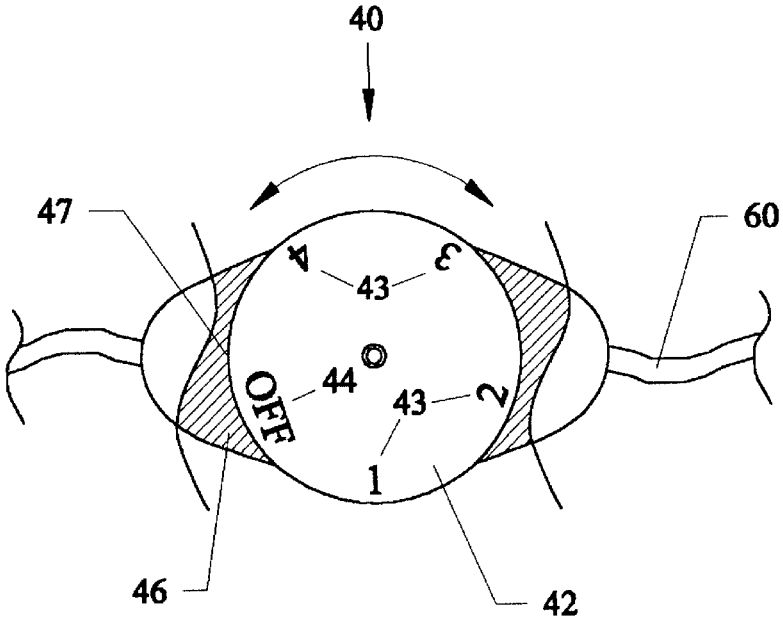

FIG. 5 is a side view of a second embodiment 100 of the warmer and nightlight device. FIG. 6 is a top view of the warmer and nightlight device 100 of FIG. 5 along arrow C. FIG. 7 is a perspective view of the second embodiment 100 with various sized containers 210, 220, 230. FIG. 8 is a top view of the rheostat control 40 of FIGS. 1 and 7 along arrow D.

Referring to FIGS. 1 and 5–8, a rheostat type control 40 can be used with both embodiments 1 and 100. The rheostat 40 can be located between the devices and the power plug 50. The rheostat 40 can include several settings 43 such as a first, second, third and fourth setting for different levels of light intensity of the light source 20 to be used in the nightlight portions 10 and 110 of both embodiments 1 and 100. The settings 43 can be on a rotatable type dial portion 42 that rotates relative to a stationary portion 46. Dial 42 can be rotated in the directions of arrow E so that one of the settings 43 can be aligned to the marker 47 on the stationary portion 46 of the rheostat control 40. For example, a first setting can be for approximately 80 degrees, a second setting for approximately 90 degrees, a third setting for approximately 100 degrees and a second setting for approximately 110 degrees. Each of the different settings also allows for different intensity levels of the light source 120 to be given off. For example, setting one can be a very dim intensity setting and setting four can be a very bright intensity setting. A separate off setting 44 allows the light source 120 to be turned off. Although four settings 43 are shown more or less can be used.

Similar to the first embodiment 1, bottom 112 of second embodiment housing 110 can include a flat portion for allowing the device 100 to be supported by a tabletop and/or floor surface.

The second embodiment includes an upper receptacle 180 having a cylindrical type opening 185 sized similar to that of the receptacle 80 and opening 85 of the first embodiment 1. On the floor portion of receptacle 180 can be a heat conductive plate 190 such as a metal plate, and the like, that can also have grid openings 195 therethrough for allowing additionally heat to pass therethrough.

On the side of receptacle 180 can be a timer control pad 150 can that can include a digital readout 154 that can give the current time. Push button type controls 152 can also be depressed to set selected times to turn on and turn off the light and heating source 120. For example, a user can set their device 100 to activate at 9:30 pm so that the substances in containers 210–240 can be warmed by a certain time, for example by 9:45 pm. Similarly, the timer control 150 can have a selected time to deactivate the heat source 20 by shutting off the source 20 at a selected time. For example, the user may wish to set the device to turn off at 12:00 midnight. Timer control 150 can also include an alarm type indicator such as a visual light such as blinking the light source 20 to notify the user when a substance has been warmed after a selected time period. Additionally, the alarm can also be audible through speakers 156, and the like, such as giving a whistle, or low level beeping noise to indicate when a selected time period has been reached. Still furthermore, the timing control 150 can also be used as an alarm type clock to give out an audible and/or visual alarm as a wakeup signal for the user. The timer control 150 can be powered by the same power supply as that of the light source 20.

FIGS. 9A, 9B, 9C, 9D, 9E and 9F show additional side openings 210, 220, 230, 240, 250, 260 for the nightlight portion of the device of the preceding figures. Side openings 115 of the second embodiment 100 and openings 15 of the first embodiment 1, can be circular. Additionally, the side openings can include other shapes such as geometrical shapes such as but not limited to rectangles, 230, triangles 250, polygons 260, and the like. Still additionally, the openings can include sliver type shapes 220, other various shapes such as stars 210, and still other types of shapes such as animals 240 and the like.

FIGS. 10A, 10B, and 110C show examples of different containers 210, 220, 230, 240 that can be held within the receptacles 80 and 180 of the preceding embodiments. For example, cylindrical containers 230, flasks 210 and tubes 220 can be used together or separately.

Although the preferred embodiments describe using a single type incandescent bulb to perform both the heating and lighting, more than one bulb can be used. For example, one bulb can be used for the nightlight and another bulb can be used for the heating source. Additionally, clear and/or colored bulbs such as yellow, black and the like can also be used. Still furthermore, other types of light sources such as but not limited to fluorescent type bulbs, light emitting diodes (LEDs), and the like, can also be used. Still furthermore, other types of heating sources can be used such as but not limited to a wire type resistive heating strip, and the like. Still furthermore, the controls can include separate controls for nightlight settings and a separate rheostat control for temperature levels.

The timer can shut off power to the bulb. Additionally, the timer can adjust the intensity of the bulb so that after a selected time period, the bulb brightness setting is reduced to a lower level after a selected time period.

While the preferred embodiment describes using a clock for selectively timing out the heat and light source, the invention can use other means such as but not limited to heat sensors adjacent to the receptacle for detecting when selected substance temperatures have been reached and then turning off the heat source.

Although the preferred embodiments describe using the novel device on a tabletop type surface, the substance receptacle and housing for light and heat source can be fitted with a side plug for being directly inserted into a conventional wall receptacle.

While the preferred embodiments describe the novel device for supporting various sized containers, the invention can also use a removable insert that would allow the user to temporarily insert various substances such as but not limited to lotions, creams, and liquids therein without having to use the original containers that held the lotions, creams, liquids and the like. For example, an extra large container of lotion can be stored in a medicine cabinet while a smaller portion is poured into the removable insert that is then inserted into the receptacle of the device.

Although, the preferred embodiments describe the invention for holding containers of lotions, creams, and liquids, the invention can also hold other types of substances such as but not limited to pastes, gels, tonics, shampoos, conditioners, and the like. Still furthermore, the user can temporarily store containers beverages such as but not limited to cups, bottles, glasses, and the like, of teas, coffees, water, sodas, drinks, and the like. Still furthermore, the receptacle can hold substances that give off smells, such as those used in aroma therapy, incense type substances, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A nightlight warmer device, comprising in combination:

a receptical having only a single opening having a substantially uniform interior diameter sidewalls therethrough for substantially encasing and holding various sized containers that each hold substances that include lotions in upright standing positions therein, the containers being selected from at least one of a tube, a flask, a bottle and a cylindrical container, wherein each of the containers is able to be held in a vertical upright position;

a housing having a source beneath the receptical for both warming the substances in the containers and the housing having at least one side opening for providing a nightlight; and a planar flat surfaced heat conductive grill with openings therethrough for additionally allowing heat to pass therethrough, the grill being formed from a different material than that of the receptical and the housing, and the planar grill with the interior sidewalls for supporting each of the various containers in vertical upright positions in the receptical.

2. The nightlight and warmer device of claim 1, wherein the substances are chosen from at least one of: lotions, cream, and liquids, and the receptical substantially encases and holds plural various sized containers.

3. The nightlight and warmer device of claim 1, wherein the opening includes at least one geometrical shape chosen from at least one of: a rectangle, a circle, a triangle, a polygon and a octagon.

4. The nightlight and warmer device of claim 1, wherein the opening includes at least one shape chosen from at least one of a sliver, a star, and an animal shape.

5. The nightlight and warmer device of claim 1, further comprising:

means for adjusting temperature of the warming source.

6. The nightlight and warmer device of claim 5, wherein the adjusting means includes:

a rheostat having at least two temperature settings and a power off position.

7. The nightlight and warmer device of claim 5, wherein the adjusting means includes:

a timer control for selecting a length of time for operating the device at a selected temperature.

8. The nightlight and warmer device of claim 5, wherein the adjusting means includes:

a timer control for selecting a time to turn on and turn off a selected temperature setting.

9. The nightlight and warmer device of claim 5, further comprising:

a visual alarm for indicating when a time period for reaching a selected temperature has occurred.

10. The nightlight and warmer device of claim 5, further comprising:

an audible alarm for indicating when a time period for reaching a selected temperature has occurred.

11. The nightlight and warmer device of claim 1, further comprising:

means for adjusting intensity of the source for the nightlight.

12. The nightlight and warmer device of claim 11, wherein the adjusting means includes:

a rheostat having at least two intensity settings and a power off position.

13. The nightlight and warmer device of claim 11, wherein the adjusting means includes:

a timer control for selecting a length of time for operating the device at a selected intensity setting.

14. The nightlight and warmer device of claim 1, further comprising:

a clock on the device for representing current time.

15. A nightlight and warmer device, comprising:

a receptical for holding individual containers each having a substance that includes lotions;

a housing having a source for both warming the substance and for providing a nightlight;

means for adjusting temperature settings of the source in order to heat the substance, and intensity levels of the nightlight;

means for programming on and off times for the adjusting means; and means for indicating an alarm when a selected time period for heating the substance has been reached.

16. The nightlight and warmer device of claim 15, wherein the alarm includes:

a visual alarm.

17. The nightlight and warmer device of claim 15, wherein the alarm includes:

an audio alarm.

18. The nightlight and warmer device of claim 15, further comprising:

a planar flat surfaced heat conductive grill with openings therethrough for additionally allowing heat to pass therethrough, the grill being formed from a different material than that of the receptical and the housing, and the planar grill with the interior sidewalls for supporting each of the various containers in vertical upright positions in the receptical, the grill being located within the receptical and above the housing, the individual containers being selected from at least one of a tube, a flask, a bottle and a cylindrical container.

19. The nightlight and warmer device of claim 18, wherein the receptical further includes:

only a single opening having a substantially uniform interior diameter sidewalls therethrough for substantially encasing and holding various sized containers that each hold substances in upright standing positions therein, wherein each of the containers is held in a vertical upright position and is supported by the planar grill and the interior diameter sidewalls of the single opening.

20. The nightlight and warmer device of claim 19, wherein the receptical substantially encasing and holds plural various sized containers.

* * * * *